US007594782B2

(12) United States Patent
Smith et al.

(10) Patent No.: US 7,594,782 B2
(45) Date of Patent: Sep. 29, 2009

(54) INTEGRAL RETAINING FOOT FOR RAMMED POST OR POLE

(76) Inventors: Michael Alexander Smith, Rd1, Ongarue Stream Road, Waimiha, Taumarunui, King Country (NZ) 3998; Carolyn Yndra Smith, Rd1, Ongarue Stream Road, Waimiha, Taumarunui, King Country (NZ) 3998

( * ) Notice: Subject to any disclaimer, the term of this patent is extended or adjusted under 35 U.S.C. 154(b) by 313 days.

(21) Appl. No.: 11/826,054

(22) Filed: Jul. 12, 2007

(65) Prior Publication Data

US 2008/0010914 A1 Jan. 17, 2008

(51) Int. Cl.
*E02D 7/14* (2006.01)

(52) U.S. Cl. ..... 405/253; 405/244; 52/155; 52/741.14

(58) Field of Classification Search ..... 405/253, 405/254, 255, 232, 231, 259.1, 244; 52/155, 52/156, 741.14
See application file for complete search history.

(56) References Cited

U.S. PATENT DOCUMENTS

| | | | | | |
|---|---|---|---|---|---|
| 1,542,498 | A | * | 6/1925 | Gardiner | 405/253 |
| 1,879,414 | A | * | 9/1932 | Munoz | 405/253 |
| 2,102,921 | A | * | 12/1937 | Schmitt | 405/253 |
| 2,947,149 | A | * | 8/1960 | Barkley, Jr. | 405/253 |
| 3,218,813 | A | * | 11/1965 | Fiore | 405/254 |
| 3,362,171 | A | * | 1/1968 | Arpaia | 405/244 |
| 3,514,959 | A | * | 6/1970 | Dougherty, Jr. | 405/255 |
| 4,269,010 | A | * | 5/1981 | Glass | 52/166 |
| 4,283,162 | A | * | 8/1981 | Parker et al. | 405/244 |
| 4,522,530 | A | * | 6/1985 | Arthur | 52/155 |
| 4,921,200 | A | * | 5/1990 | Moraly | 52/155 |
| 5,775,848 | A | * | 7/1998 | Blankinship et al. | 405/244 |

* cited by examiner

*Primary Examiner*—Frederick L Lagman

(57) ABSTRACT

By attaching a formed steel plate in the shape of a tapered arrowhead with fins at each of the four corners, to the base of a post it is possible to ram a post with a integral foot that will secure it in the ground and for that post or pole to resist both upward and rotational pressure.

3 Claims, 2 Drawing Sheets

INTEGRAL RETAINING FOOT FOR RAMMED POST OR POLE

BACKGROUND

It is good fencing practice to fit a retaining Foot to key posts when erecting a fence. This would include the strainer post at each end of the proposed fence, angle post where there is a change in direction along the fence line and on those intermediate posts which are deemed at risk.

The task of the Foot is to prevent the post lifting out of the ground when tension is applied as in the case of a high tensile wire fence such as those used on the majority of New Zealand farms for stock management.

The foot can be made out of a variety of materials and is secured to the lower part of the post in such a way as to protrude into the surrounding ground so that when the hole dug for the post is rammed up the Foot is a major obstruction to the movement of the post. This has been the practice in those fences where the posts have been individually dug in.

There is a growing trend to use a post ramming machine to speed up the fencing task. These post rammers preclude the use of the traditional foot system and a variety of innovative solutions are being used to apply a Foot to a post after ramming.

All of these solutions require supplementary work on the post in question to implant the Foot substitute.

The rammed post approach to post erection needs a foot solution that is integrated with the ramming operation.

The same issues apply when ramming a post or pole for a construction project.

DESCRIPTION OF INVENTION

Figure 1:
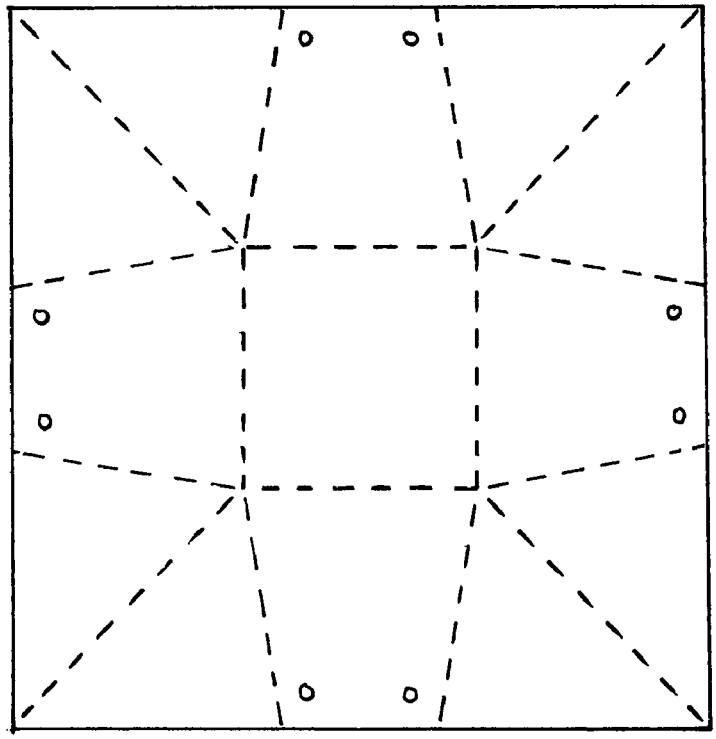
FIG. 1 shows the steel plate prior to pressing with the forming lines marked.

The Integral Retaining Foot for a Rammed Post or Pole is a pressed steel unit formed from a square of medium gauge galvanized steel (FIG. 1 shows the flat steel plate prior to folding with the fold lines marked) that attaches to the base of the post or pole after first preparing the base to receive it.

Figure 2:
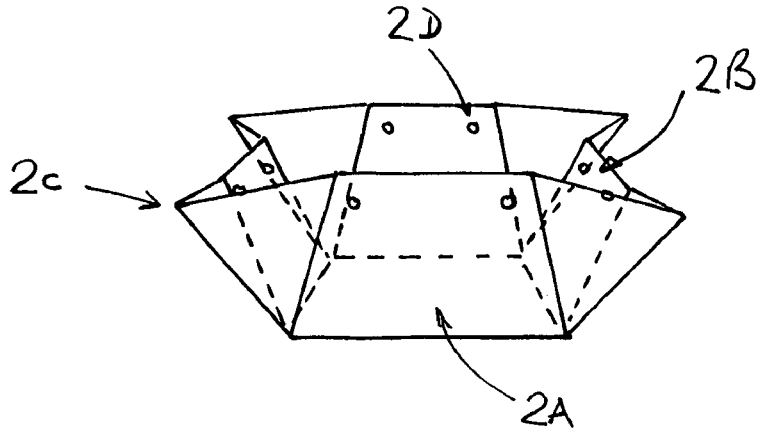
FIG. 2 is a perspective view of the plate after forming, showing the square center base 2A, the angled side panels 2B and the tapered arrow shaped fins 2C at each of the four corners; also the mounting holes 2D.

In the forming process the square of steel plate is pressed into a deep three dimensional shape resembling an arrow head with four barbs but with a flat point. The steel is not stretched in the process but creased into shape and therefore maintains its full thickness throughout. (FIG. 2 perspective view of the plate after folding showing the square base 2A, the tapered sidewalls 2B and the dart shaped fins 2C at each of four corners).

A number of mounting points for nailing the foot to the post are also punched into the plate (2D).

The base of the post or pole must be prepared to receive this unit.

Figure 3:
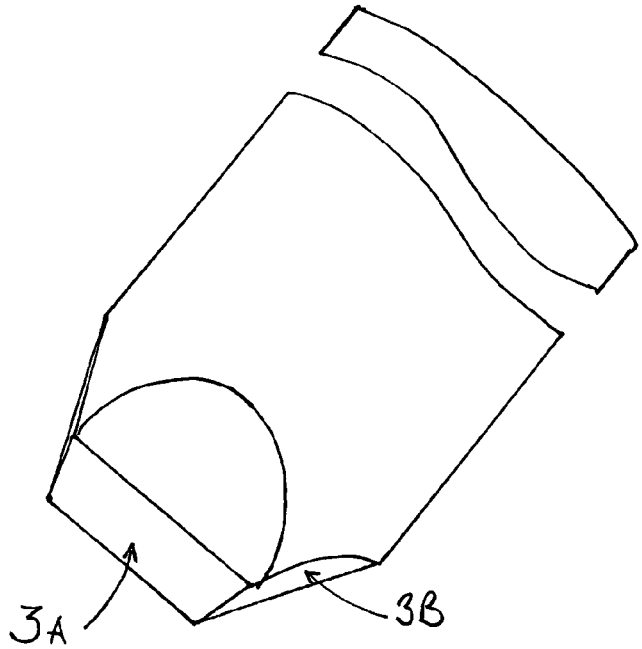
FIG. 3 the base of the post has been trimmed using a chain saw, firstly to cut the base square 3A and then to cut the four angle faces 3B to correspond with the side panels of the steel pressing.
Figure 4:
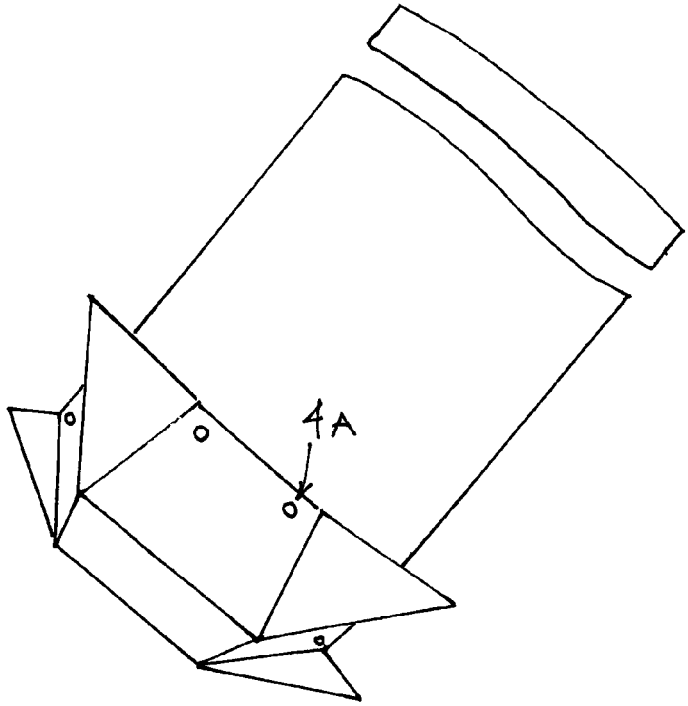
FIG. 4 the steel pressed foot has been positioned on the base of the post and is ready for nailing up through the punched holes 4A.

Firstly the post must be trimmed square. Then four cuts with a chain saw are made to match the angles of the plate (see FIG. 3). This ensures that all angles of the plate are securely supported by the post. The plate is then fitted to the post by skew nailing up using a very heavy gauge brad nail (see FIG. 4).

The post or pole now with the Integral Retaining Foot in position is placed directly under the ramming machine and driven down to the required depth.

As the post moves down through the soil structure the narrower entry provided by the tapered square will force the ground to accept the post more rapidly and compress the displaced material to the side to impinge on the main body of the post.

The protruding arrowhead fins on each corner will penetrate the soil smoothly and on reaching the required depth allow the displaced material to return to occupy the space displaced by the fins during their downward movement.

The fins will now act as an anchor with the open top of the fin absorbing material previously displaced and locking the base of the post in the ground.

In addition to preventing upward movement the fins will also eliminate horizontal rotation of the post.

The Integral Retaining Foot for a rammed post therefore fulfills both tasks previously undertaken by the traditional dug in post and foot systems and allows the wider use of ramming with confidence using the new foot system described in this invention.

It will be appreciated that the invention consists in the parts, elements and features described in this specification, and is deemed to include any equivalents known in the art which, if substituted for the described integers, would not materially alter the substance of the invention.

The invention claimed is:

1. A retaining foot for a post or pole that can be attached to the post prior to ramming into the ground, pressed from a square of steel plate of medium gauge, finished with a galvanised coating, whereby the steel plate is formed to take up a deep three dimensional shape incorporating a flat square panel at its centre and four flat side panels each connected to one side of the square, inclined at an angle of approximately 60 degrees from the square centre panel and incorporating apertures for fixing the foot to the post with the corners of the plate between the flat side panels folded into flared fins of a tapered triangular profile resembling the flights of a dart so that the finished shape of the pressed foot closely resembles that of an arrowhead with a flat squared off point and that the tapered profile of the overall shape will facilitate an easy entry into the ground for the post when using a ramming machine but act as a barb and engage the surrounding material into which the post has been rammed preventing the fence post being draw out when lifting pressure is applied to the post.

2. A method of fixing the retaining foot as claimed in claim 1 to the base of a post includes that a post be first trimmed across the base to provide a flat mounting surface and then four flat panels are cut up the post from the base to correspond exactly with the shape of the pressed steel foot so that the outcome is a square base with flat panels connecting to each of the four sides of the square base at an angle of approximately 60 degrees from the base providing a tapered profile for the foot with the narrower end of the taper at the base and flaring out up the body of the post so that when the foot is offered up to the base of the post the foot fits tightly to the square base and the four flat side panels and the retaining nails can then be inserted through the apertures in the side panels of the foot and the foot made secure against the post.

3. A method of installing a post or pole into the ground including that the post now fitted with the foot as claimed in claim 1 can now be positioned into a ramming machine with the foot at the point of, entry into the ground required for the post and the normal ramming process can be undertaken driving the post into the ground with the foot attached and when the post has reached the required depth the foot as claimed in claim 1 will, with the principal action of the tapered fin profile in each of the four corners prevent the post from lifting out of the ground and rotating in the ground.

* * * * *